US005157799A

United States Patent [19]

Aird

[11] Patent Number: 5,157,799

[45] Date of Patent: Oct. 27, 1992

[54] ZIPPERED PILLOWCASE

[76] Inventor: Vivian Aird, 280 St. Joseph Ave., Long Beach, Calif. 90803

[21] Appl. No.: 793,473

[22] Filed: Nov. 18, 1991

[51] Int. Cl.[5] ..... A47G 9/00

[52] U.S. Cl. ..... 5/490; 5/501

[58] Field of Search ..... 5/490, 482, 413, 501; D6/601

[56] References Cited

U.S. PATENT DOCUMENTS

| | | | |
|---|---|---|---|
| 1,343,881 | 6/1920 | Christensen | 5/490 |
| 4,604,765 | 8/1986 | Schultz | 5/413 |
| 5,027,457 | 7/1991 | Sweet | 5/490 |

FOREIGN PATENT DOCUMENTS

| | | | |
|---|---|---|---|
| 2804534 | 8/1979 | Fed. Rep. of Germany | 5/490 |
| 2613606 | 10/1988 | France | 5/501 |
| 6776 | of 1912 | United Kingdom | 5/490 |

*Primary Examiner*—Alexander Grosz
*Attorney, Agent, or Firm*—Charles H. Thomas

[57] ABSTRACT

A pillowcase for a king size bed pillow is provided with a releasable fastener, such as a zipper, that extends along adjacent long sides of the fabric layers forming the pillowcase. Since a pair of the short sides of the fabric layers are always open, the layers may be separated along at least two adjacent sides to facilitate insertion and removal of a pillow between the layers. The sides of the layers opposite the open end of the pillowcase may also be secured by a releasable fastener, such as an elongated, L-shaped zipper so that the layers may be separated along three sides and opened like a book to receive a pillow. By employing a releasable fastener along at least one of the long pair of adjacent sides of the pillowcase layers, the task of inserting a pillow into the pillowcase is greatly facilitated.

12 Claims, 2 Drawing Sheets

ZIPPERED PILLOWCASE

BACKGROUND OF THE INVENTION

1. Field of the Invention

The present invention relates to an improved form of pillowcase for use on a pillow for a bed.

2. Description of the Prior Art

Conventional pillowcases for beds are typically formed of one or more sheets of a soft, flexible fabric, such as cotton, which is often cut from a fine, closely woven percale cloth. Bedpillows are normally constructed in a generally rectangular shape from congruent, rectangular layers of cloth which are sewn together along their edges to form a bag or sack filled with some type of soft stuffing, such as feathers, shredded foam rubber, shredded polyurethane foam, or some other soft, comfortable material. The cushioning material which fills the pillow is not readily washable, due either to a tendency to disintegrate with washing, a tendency to retain moisture, or a tendency to lose the characteristic soft, springy resiliency for which the material is selected in the first place. Consequently, it is desirable to protect a pillow from exposure to dirt and the oils of a persons skin or hair so as to avoid the necessity for washing the pillow. For this reason pillowcases or pillowslips are employed as outer surface coverings for bedpillows.

A conventional pillowcase for a pillow for a bed is typically formed of a sheet of fabric either woven in a tubular shape or as a flat sheet of material. In either case the sheet of material is formed into a pair of layers disposed one atop the other between which a pillow can be inserted. A conventional pillowcase for a bedpillow is usually configured in a generally rectangular configuration. Each layer of the fabric sheet has a pair of mutually opposing long edges or sides extending parallel to each other, and mutually parallel short edges or sides that extend generally perpendicular to the long sides. The mutually adjacent sets of long sides of the two fabric layers are permanently secured to each other, either by sewing or by the initial formation of the sheet of material in a tubular shape. When flattened together the layers define pairs of mutually opposing longitudinal folds or seams that define the relatively long sides of the two fabric layers.

Whatever the construction, a conventional pillowcase is permanently closed along both the relatively long mutually adjacent sets of sides of the two fabric layers. The pillowcase is open at one end between one set of relatively short sides of the two fabric layers and is permanently closed at the other end by the other set of opposing short sides of the two fabric layers. The closure at the end of the bed pillowcase is normally accomplished by sewing the set of adjacent short edges or sides of the two fabric layers at the opposite end of the pillowcase together while the pillowcase is turned inside out. The seam is then concealed when the pillowcase is turned right side out for use. A pillow is conventionally inserted into and removed from the pillowcase through the single opening defined between the set of short, adjacent sides of the two fabric layers which are totally disconnected from each other throughout the width of the pillow at one end thereof.

Due to the very soft nature of a pillow, and the relatively close fit which is desirable between a pillow and its encapsulating pillowcase, it is often difficult to insert a pillow into a conventional pillowcase, particularly when the user is elderly and has limited strength. This problem is particularly acute in the case of relatively large bedpillows, such as those designed for use on king size beds. One technique employed in inserting a pillow into a conventional pillowcase is for the user to gather up the material of the pillowcase along both of the sets of longitudinal or long sides of the pillowcase structure, thereby creating accordion like folds in the pillowcase until the gathered length of the pillowcase has been reduced to only a few inches. The compacted pillowcase is then positioned at one end of the pillow and the user then attempts to draw the gathered folds apart and to work the pillowcase down the complete length of the pillow. Because the structure of the pillow is resilient and soft, it tends to yield so that the pillowcase does not slide smoothly along the surface of the pillow. Thus, this technique for inserting a pillow into a pillowcase takes a considerable amount of time, patience and physical strength.

Another technique which is sometimes employed in inserting a pillow into a pillowcase is to grip one of the short sides or ends of a pillow with one hand while holding the pillow beneath the arm of the hand gripping the pillow. The hand gripping the pillow, together with the pillow, are then pushed into the pillowcase. The other hand is employed to alternatively pull the sides of the pillowcase along the surface of the pillow as the arm of the hand gripping the pillow is gradually extended. Once the pillow has been pushed into the pillowcase in this manner the grip on the pillow is released and the arm is withdrawn. The difficulty with this technique is that it requires considerable strength. There is a considerable amount of frictional resistance encountered in pulling the pillowcase along the length of the pillow. Moreover, the pillowcase must be pulled along the pillow using but a single hand, since the other hand is fully occupied in maintaining a grip on the pillow as the pillow is forced into the case. Furthermore, the shorter a person's arms the less will be the extent to which the pillows can be forced into the case before the grip on the pillow must be released.

All of the conventional techniques for inserting a bed pillow into a pillowcase are somewhat difficult to perform, particularly in the case of the elderly, who often have limited strength.

The problem of inserting a pillow into a pillowcase is particularly great for pillows and pillowcases which have a relatively great length, such as those designed for use on king size beds. For example, a California or western king size bed is 72 inches in width and 84 inches in length. A dual king or east coast king size bed is 78 inches in width and 80 inches in length. Thus, each pillow for a king size bed is typically between about 36 and 39 inches in length. Like pillows for smaller beds, pillows for a king size bed are typically between about 18 and 20 inches in width. A pillow for a king size bed therefore has a length typically at least twice as great as its width. The great length of a king size pillow relative to its width makes the insertion of a king size pillow into a pillowcase designed for that pillow significantly more difficult than the insertion of a pillow for a smaller bed into a pillowcase designed for that pillow.

SUMMARY OF THE INVENTION

The present invention involves the provision of a pillowcase designed to facilitate insertion of a pillow into a pillowcase. Using a pillowcase constructed in accordance with the invention a person is able to insert and encapsulate a pillow within a pillowcase far more easily than can be done using pillowcases of a conventional design. The invention is particularly advantageous for inserting pillows for king size beds into pillowcases constructed to receive those pillows.

A further object of the invention is to provide a system for inserting pillows for beds into pillowcases which can be accomplished with a minimum of physical strength. This is particularly advantageous to people who are infirm or who are limited in strength, such as elderly persons.

Yet another object of the invention is to provide a pillowcase which not only eases the task of encasing a pillow therewithin, but which also facilitates removal of the pillow therefrom.

According to the invention the conventional pillowcase construction in which a rectangular pillowcase is closed on both long sides and on one of the short sides, and is only open at the other short side, is altered. This is done by constructing at least one of the long sides of the pillowcase with some releasable fastening means. This releasable fastener preferably takes the form of a zipper, although other types of releasable fasteners, such as snaps, buttons and fabric hook and loop releasable closure devices of the type sold under the registered trademark "Velcro" may also be employed for the same purpose.

The zipper or other releasable closure extends along at least a set of mutually adjacent long edges of the layers of fabric of a pillowcase from the short, open edges thereof to the remote opposing short edges. These remote short edges of the layers of fabric forming the pillowcase may either be permanently closed in the conventional manner, or releasable closed by providing a zipper long enough to extend from the releaseably closed long edges transversely across the opposing short edges of the pillowcase layers opposite the open end of the pillowcase. Both configurations of pillowcase construction greatly simplify the task of insertion of a pillow into a pillowcase. This is particularly true of pillows having a high ratio of length to width, such as those employed for use on king size beds.

In one broad aspect the present invention is an improvement in a pillowcase for a bedpillow formed of a sheet of fabric folded to form congruent rectangular fabric layers and having an open end along adjacent short sides of the rectangular layers. According to the improvement of the invention the rectangular layers are releasably secured together along mutually adjacent long sides by releasable fastening means. That is, the two fabric layers are releasably secured along a set of long sides or edges of the fabric layers that extend perpendicular to the short, transverse edges which define both the open end of the pillow and an opposite short end. Preferably, the releasable fastening means is a zipper.

In one embodiment of the invention the zipper extends only along a single set of longitudinal edges of the adjacent fabric layers. The zipper extends from the short sides of the layers which are open with respect to each other along their entire lengths and terminates at the opposite set of short sides of the pillow which are sewn together and thereby permanently closed in the conventional manner. In this embodiment the zipper opens along a linear path that extends the length of the pillow, thus allowing a generally triangular flap of one of the layers fabric to be folded back from the other layer. When the zipper is opened in this manner the two fabric layers are separated from each other along two adjacent sides, namely the customary short pair of sides of the two layers which are never secured together and an adjacent set of long sides of the layers which are releasably secured together.

In another embodiment of the invention the zipper does not terminate at the end of the pillowcase opposite the open mouth defined between the disconnected short sides of the layers, but to the contrary extends in an "L-shaped" path along the opposite set of short sides of the pillowcase layers at the end of the pillowcase opposite the short, permanently disconnected sides. In this embodiment the zipper can be unzipped so that the layers are then separated from each other along three sides. One entire layer of fabric can then be folded completely back and out of contact with the other layer of fabric. The pillow can then be positioned atop one of the layers and the other layer can be folded back across the pillow. The zipper is then zipped up, first along the releasably secured set of short sides of the layers defining the structure of the pillowcase, and then along the set of long sides of the layers that terminate at the open end of the pillow.

In another broad aspect the invention may be considered to be a pillowcase for a bed comprising a generally rectangular sheet of fabric material folded to form a pair of congruent rectangular layers with sets of adjacent sides, each layer having mutually opposing long and short sides. Each of the layers is permanently connected to the other on one of its long sides where the material is folded. Each of the layers also includes a releasable fastening means along its opposing long side, whereby a set of the opposing long sides of the fabric layers are releasably securable together. Each of the layers is completely free and disconnected from the other along one of its short sides, as in the conventional manner, and is connected to the other layer along its opposing short side.

The invention may be described with greater clarity and particularity with reference to the accompanying drawings.

DESCRIPTION OF THE EMBODIMENT

Figure 1:
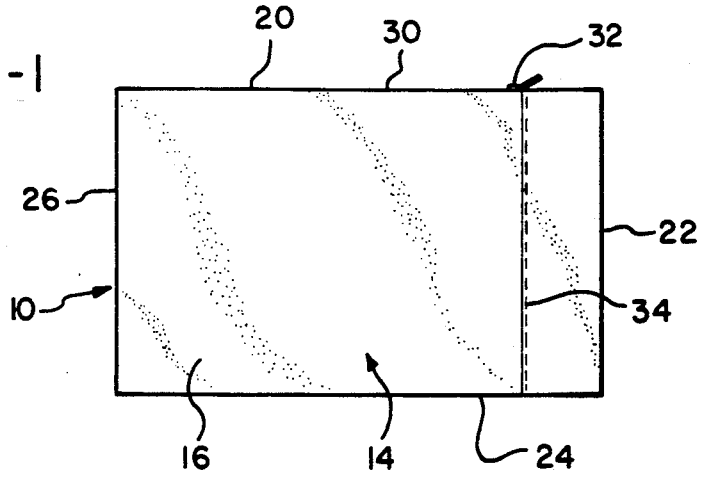
FIG. 1 is a top plan view of one embodiment of an improved pillowcase according to the invention with a pair of congruent layers of fabric forming a pillowcase releasably secured by a zipper along a set of adjacent long sides.
Figure 2:
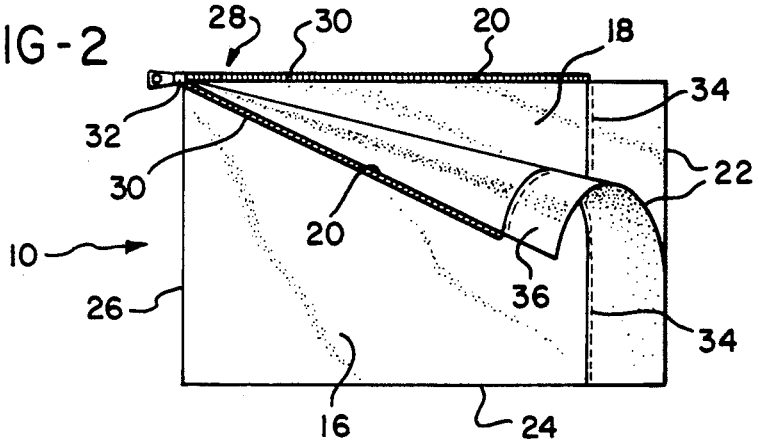
FIG. 2 is a top plan view of the pillowcase of FIG. 1 with the zipper thereof unzipped and with a flap of one of the layers folded back from the other.
Figure 3:
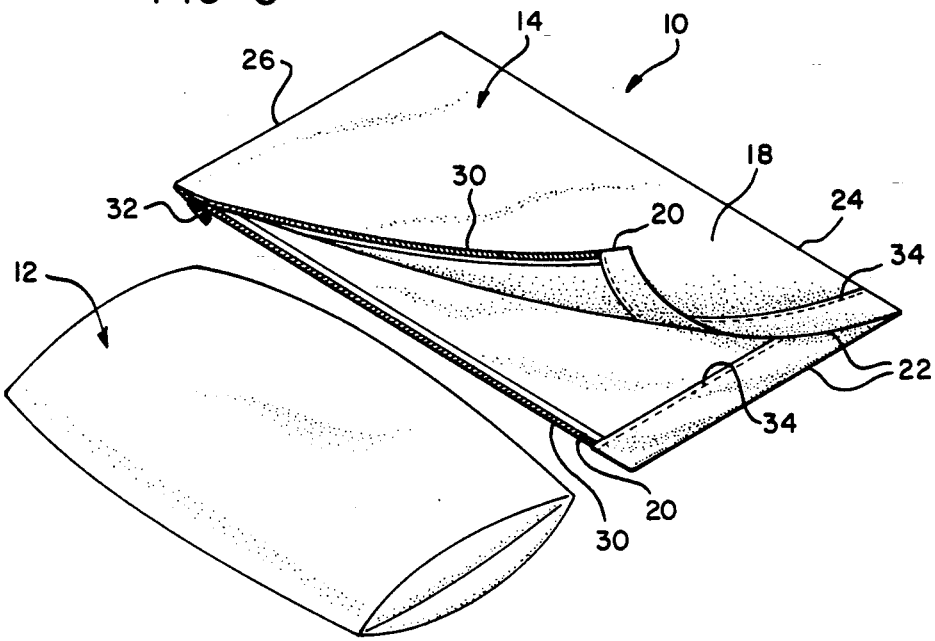
FIG. 3 illustrates the manner of insertion of a pillow into the pillowcase of FIGS. 1 and 2.

FIGS. 1, 2 and 3 show a pillowcase 10 for a bedpillow 12 formed of a sheet of fabric 14 folded to form congruent rectangular fabric layers 16 and 18. The peripheral extremities of the rectangular layers 16 and 18 define sets of adjacent sides which are indicated by like reference numbers. That is, the long sides 20 of each of the layers 16 and 18 form one set of adjacent sides, as do the short sides 22 thereof. Likewise, the sides 24 of each of the layers 16 and 18 form an adjacent set of long sides as do the other short sides 26 of each of the layers 16 and 18. Each of the layers 16 and 18 has mutually opposing long sides 20 and 24 and mutually opposing short sides 22 and 26.

Each of the layers 16 and 18 is permanently connected to the other layer along its long side 24, which is formed by a fold in the fabric sheet 14. Each of the layers 16 and 18 also includes a releasable fastening means, in the form of a zipper 28 having a line 30 of interleavable zipper teeth along each of the long sides 20 of the two layers 16 and 18. The lines 30 of zipper teeth are brought into mutual engagement and disengagement by a conventional zipper slide 32 which traverses the length of the long sides 20 of the fabric layers 16 and 18. The set of long sides 20 of the layers 16 and 18 are thereby releasably securable together by means of the zipper 28. The long sides 20 with the lines 30 of zipper teeth thereon lie opposite the opposing long sides 24 of each of the layers 16 and 18.

Each of the layers 16 and 18 is disconnected from the other along one of its short sides, namely along the set of short sides 22, which are both formed with marginal hems. Each hem is sewn separately along a line of stitching 34. The layers 16 and 18 are both connected to each other along their opposing short sides 26. In the embodiment of FIGS. 1–3 the short sides 26 of the two layers 16 and 18 are connected together by a line of stitching which is concealed from view in the conventional manner between the two layers 16 and 18.

The pillowcase 10 with the releasable set of long sides 20 finds its greatest advantage when used with pillows for a king size bed. Typically, each of the long sides 20 and 24 is between about thirty and thirty nine inches in length, while each of the short sides 22 and 26 is between about eighteen and twenty inches in length. The long sides 20 and 24 are typically about twice the length of the shorter sides 22 and 26.

To use the pillowcase 12, the zipper slide 32 is first unzipped from a position proximate to the disconnected short sides 22 at the right of the pillowcase 12, as depicted in FIG. 1, all the way to the left until the slide 32 reaches the opposing short sides 26 of the layers 16 and 18, as depicted in FIG. 2. When the zipper slide 32 has been unzipped in this manner, there are two adjacent sets of sides which are fully open to admit a pillow 12, as illustrated in FIG. 3. Specifically, the set of short sides 22 and the adjacent set of long sides 20 of the two layers 16 and 18 are separable such that a generally triangular flap 36 of either of the layers 16 and 18 can be peeled back from the other layer. The pillow 12 can thereupon be placed easily in between the two layers 16 and 18 along the entire length of the releasably securable sides 20 toward the opposing set of long sides 24 of the two layers 16 and 18.

Once the pillow 12 has been fully inserted in between the two layers 16 and 18 in this manner, the zipper slide 32 is moved along the lines 30 of zipper teeth throughout the entire length of the set of long sides 20 from the permanently closed short sides 26 toward the opposite, permanently disconnected short sides 22. The zipper teeth along the sides 20 are thereupon mutually engaged together so that the pillow 12 is snugly encased between the layers 16 and 18 with a minimum of effort. The zipper slide 32 may be unzipped in the manner previously described to facilitate removal of the pillow 12 when the pillowcase 10 is to be laundered.

Figure 4:
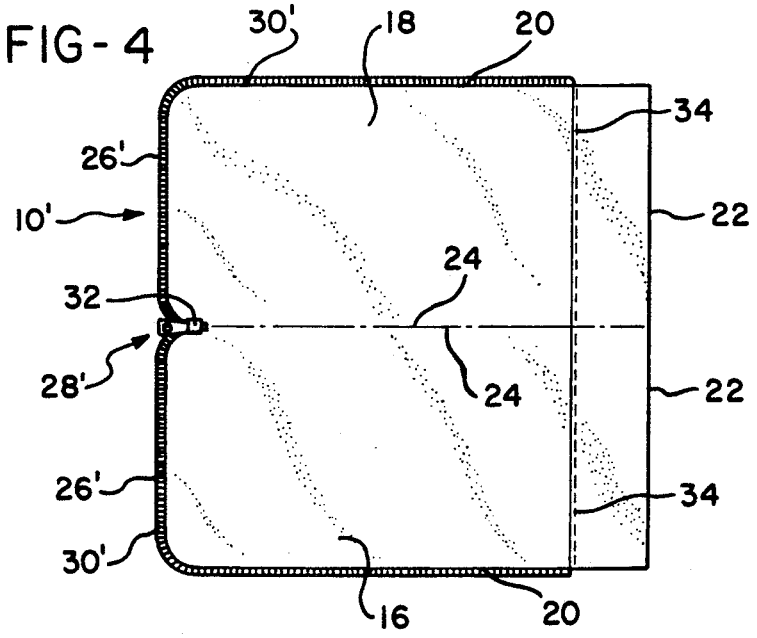
FIG. 4 is a top plan view of an alternative embodiment of the invention shown totally unzipped.
Figure 5:
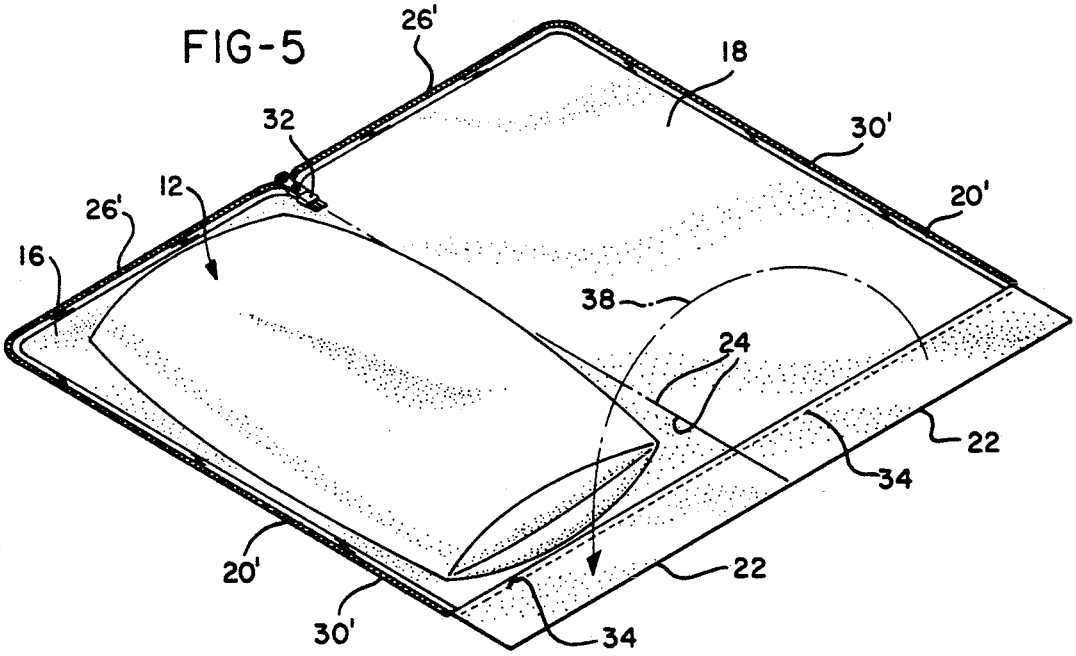
FIG. 5 illustrates the manner of encasing a pillow in the pillowcase of FIG. 4.

FIGS. 4 and 5 illustrate a pillowcase 10' which represents an alternative embodiment of the invention. Like the pillowcase 10, the pillowcase 10' is designed for use as a bedpillow for a king size bed and is formed as a pair of congruent rectangular layers 16 and 18 having a length about twice as great as their width. As in the pillowcase 10, the layers 16 and 18 of the pillowcase 10' are open at a first set of mutually adjacent short edges 22 and have opposite mutually adjacent short edges 26'. The layers 16 and 18 also have pairs of sets of mutually adjacent long edges 20 and 24 extending between the short edges 22 and 26'.

As in the embodiment of FIGS. 1–3, the layers 16 and 18 of the pillowcase 10' are releasably secured together along the set of mutually adjacent long edges 20. The edges 20 are secured together in releasable fashion by means of a zipper indicated generally at 28' which has a slide 32 that travels along lines 30' of zipper teeth. Unlike the lines 30 of zipper teeth of the pillowcase 10, the lines 30' of zipper teeth of the pillowcase 10' each extend in a generally L-shaped configuration not only along the long edge 20 of each of the layers 16 and 18. To the contrary, they also extend along the mutually adjacent short edges 26' that are opposite the open end of the pillowcase 10' that is formed at the other set of short edges 22. The sets of long edges 20 and short edges 26' are thereby both releasably secured together by a single zipper 28'. The single elongated zipper 28' extends the length of the set of mutually adjacent long edges 20 and curves over to also extend the length of the mutually adjacent short edges 26' that are opposite the disconnected short edges 22.

To utilize the pillowcase 10', the zipper slide 32 is moved from a position on the lines 30' of zipper teeth proximate the open short edges 22 of the layers 16 and 18 along the entire length of the long edges 20. Movement of the slide 32 continues along the entire length of the short edges 26' to the position depicted in FIGS. 4 and 5. The layers 16 and 18 can then be folded back like the pages of a book into a single, flat sheet as depicted in FIGS. 4 and 5.

A pillow 12 is then placed atop either one of the layers 16 or 18, and the other layer is then folded back over the pillow 12 as indicated by the directional arrow 38 in FIG. 5 to cover the pillow 12. The zipper slide 32 is then moved along the lines 30' of zipper teeth on the set of edges 26' toward the longer edges 20 from the starting position at the ends of the opposing long edges 24 depicted in FIGS. 4 and 5. Upon reaching the long edges 20, the zipper slide 32 is brought around the corner transition between the short sides 26' and longer sides 20 and pulled along the entire length of the long sides 20 to the ends of the lines 30' of the zipper teeth proximate to the open short sides 22 of the pillowcase 10'. The pillow 12 is thereupon easily encased between the layers 16 and 18, which are permanently secured along their mutually adjacent set of edges 24, releasably secured along the sets of edges 26' and 20, and totally open at the set of edges 22.

It can be seen that with either embodiment the insertion and removal of a pillow into and out of a pillowcase according to the invention can be accomplished far more easily and with far less strength than is possible using conventional pillowcases. The use of a pillowcase according to the invention avoids the tugging and pulling which is necessary to move two flexible materials past each other as is necessary in order to insert a bedpillow into a conventional pillowcase. The zippers employed are preferably plastic so that they will not rust when the pillowcases are washed Undoubtedly, numerous variations and modifications of the invention will become readily apparent to those familiar with bedding. For example, the invention is not limited to use with pillows for king size beds, but is also useful for standard or queen size pillows as well. Accordingly, the scope of the invention should not be construed as limited to the specific embodiments depicted and described, but rather is defined in the claims appended hereto.

I claim:

1. In a pillowcase for a bed pillow constructed of a sheet of fabric folded to form congruent rectangular fabric layers permanently secured together along a first pair of mutually adjacent long sides by a fold in said sheet and having an end which is completely open along a first pair of adjacent short sides of said rectangular layers, said first pair of short sides being completely free and disconnected from each other throughout their entire lengths, and having a second pair of short sides connected throughout their length, the improvement wherein said rectangular layers are releasably secured together along the lights of a second pair of mutually adjacent long sides by continuous releasable fastening means which terminate proximate to said free and disconnected short sides at said completely open end to thereby hold said second pair of mutually adjacent long sides in continuous unbroken contact with each other from said second pair of short sides to the termination of said releasable fastening means at said open end.

2. A pillowcase according to claim 1 wherein said releasable fastening means is a zipper.

3. A pillowcase according to claim 1 wherein said rectangular layers are also releasably secured together along said second pair of short sides opposite said open end by said releasable fastening means.

4. A pillowcase according to claim 3 wherein said releasable fastening means is a single zipper that extends along the aforesaid mutually adjacent long and short sides of said layers.

5. In a pillowcase for a bed pillow formed with a pair of congruent rectangular layers having a length about twice their width and open at a first set of mutually adjacent short edges which are completely free and permanently disconnected from each other throughout their entire lengths and having an opposite mutually adjacent set of short edges which are connected together throughout their lengths, and first and second pairs of mutually adjacent long edges extending between said short edges, wherein said long edges in said first pair are permanently secured together throughout their lengths, the improvement wherein said layers are releasably secured together along at least said second pair of mutually adjacent long edges by releasable fastening means which extend continuously along the lengths of said second pair of mutually adjacent long edges and terminate proximate to said first set of mutually adjacent short edges to thereby hold said second pair of mutually adjacent long edges in continuous, unbroken contact with each other from said opposite set of short edges to the termination of said releasable fastening means proximate to said first set of short edges.

6. In a pillowcase according to claim 5 the further improvement wherein said layers are additionally releasably secured together along said opposite mutually adjacent short edges.

7. In a pillowcase according to claim 6 the further improvement comprising a single elongated zipper that extends the length of said second pair of mutually adjacent long edges and also the length of said opposite mutually adjacent short edges.

8. In a pillowcase according to claim 5 the further improvement wherein said layers are releasably secured together by a zipper extending along said second pair of mutually adjacent long edges.

9. A pillowcase for a bed pillow comprising a generally rectangular sheet of fabric material folded to form a pair of congruent rectangular layers with sets of adjacent sides, each layer having first and second mutually opposing long and short sides, wherein each of said layers is permanently connected to the other along a first of its long sides where said material is folded, and is permanently free and totally disconnected relative to the other along the entire length of a first of its short sides to thereby form a permanently open end, and each of said layers includes a continuous releasable fastening means along a second opposing long side and which terminates proximate said permanently open end, whereby said second opposing long sides of said layers are releasably securable together in unbroken contact with each other from said second short sides to the termination of said releasable fastening means proximate said permanently open end, and each of said layers is connected to the other along said second opposing short sides.

10. A pillowcase according to claim 9 further comprising a zipper for releasably securing said second opposing long sides of said layers together.

11. A pillowcase according to claim 10 wherein said zipper extends along the aforesaid second opposing long sides and also along said second opposing short sides opposite said first short sides which are permanently free and totally disconnected relative to each other, whereby said layers are releasably securable together by said zipper along both said second opposing long sides and said second opposing short sides.

12. A pillowcase according to claim 9 for a king size bed pillow.

* * * * *